US008939552B2

(12) United States Patent
Mardilovich et al.

(10) Patent No.: US 8,939,552 B2
(45) Date of Patent: Jan. 27, 2015

(54) THERMAL FLUID-EJECTION ECHANISM HAVING HEATING RESISTOR ON CAVITY SIDEWALLS

(75) Inventors: Peter Mardilovich, Corvallis, OR (US); Lawrence H. White, Corvallis, OR (US); Erik D. Torniainen, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/978,571

(22) PCT Filed: Jan. 31, 2011

(86) PCT No.: PCT/US2011/023224

§ 371 (c)(1),
(2), (4) Date: Jul. 8, 2013

(87) PCT Pub. No.: WO2012/105946

PCT Pub. Date: Aug. 9, 2012

(65) Prior Publication Data

US 2013/0286104 A1 Oct. 31, 2013

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC *B41J 2/05* (2013.01); *B41J 2/1412* (2013.01); *B41J 2/1603* (2013.01); *B41J 2/1626* (2013.01); *B41J 2002/14387* (2013.01)

USPC ..... 347/61

(58) Field of Classification Search

None

See application file for complete search history.

(56) References Cited

U.S. PATENT DOCUMENTS

| | | | | |
|---|---|---|---|---|
| 6,378,984 | B1 | 4/2002 | Steinfield et al. | |
| 6,561,626 | B1 * | 5/2003 | Min et al. | 347/47 |
| 7,207,661 | B2 | 4/2007 | Chou et al. | |
| 7,210,766 | B2 | 5/2007 | Kuk et al. | |
| 7,475,966 | B2 | 1/2009 | Fujii et al. | |
| 7,533,968 | B2 | 5/2009 | Silverbrook | |
| 2006/0038855 | A1 | 2/2006 | Kim et al. | |
| 2006/0098055 | A1 * | 5/2006 | Fujii et al. | 347/65 |
| 2009/0009562 | A1 | 1/2009 | Park et al. | |
| 2009/0141087 | A1 * | 6/2009 | Lee et al. | 347/63 |
| 2009/0256887 | A1 | 10/2009 | Inoue et al. | |

FOREIGN PATENT DOCUMENTS

| | | |
|---|---|---|
| CN | 100389959 | 5/2008 |
| KR | 20050122896 | 12/2005 |

* cited by examiner

*Primary Examiner* — Matthew Luu
*Assistant Examiner* — Erica Lin
(74) *Attorney, Agent, or Firm* — Michael A. Dryja

(57) ABSTRACT

A thermal fluid-ejection mechanism includes a substrate having a top surface. A cavity formed within the substrate has one or more sidewalls and a floor. The angle of the sidewalls from the floor is greater than or equal to nominally ninety degrees. The thermal fluid-ejection mechanism includes a patterned conductive layer on one or more of the substrate's top surface and the cavity's sidewalls. The thermal fluid-ejection mechanism includes a patterned resistive layer on the sidewalls of the cavity. The patterned resistive layer is located over the patterned conductive layer where the patterned conductive layer is formed on the sidewalls of the cavity. The patterned resistive layer is formed as a heating resistor of the thermal-fluid ejection mechanism. The conductive layer is formed as a conductor of the thermal-fluid ejection mechanism, to permit electrical activation of the heating resistor to cause fluid to be ejected from the thermal fluid-ejection mechanism.

15 Claims, 6 Drawing Sheets

THERMAL FLUID-EJECTION ECHANISM HAVING HEATING RESISTOR ON CAVITY SIDEWALLS

RELATED APPLICATIONS

The present patent application is related to the previously filed and pending PCT patent application entitled "thermal inkjet printhead with heating element in recessed substrate cavity," filed on Oct. 27, 2009, and assigned patent application number PCT/US2009/062195 [attorney docket no. 2009003106-1].

BACKGROUND

One type of printing device is a thermal inkjet-printing device. A thermal inkjet-printing device forms images on media like paper by thermally ejecting drops of fluid onto the media in correspondence with the images to be formed on the media. The drops of fluid are thermally ejected from the thermal inkjet-printing device by using a heating resistor. When electrical power is applied to the heating resistor, the resistance of the heating resistor causes the resistor to increase in temperature. This increase in temperature results in the drops of ink being ejected.

DETAILED DESCRIPTION

As noted in the background section, a thermal inkjet-printing device ejects drops of fluid onto media by applying electrical power to a heating resistor, which ultimately results in the drops of ink being ejected. A thermal inkjet-printing device is one type of thermal fluid-ejection device that employs heating resistors to thermally eject fluid. Most traditionally, a heating resistor is located on a substrate at the bottom of a fluid chamber of a thermal fluid-ejection mechanism of a thermal fluid-ejection device.

However, this configuration is somewhat disadvantageous. The manner by which a heating resistor is able to cause a drop of fluid to be ejected from its thermal fluid-ejection mechanism is that heating of the resistor results in the formation of a bubble within the fluid chamber. This bubble displaces a drop of fluid that is ejected from the thermal fluid-ejection mechanism. The bubble subsequently collapses on the substrate of the fluid chamber. As such, the bubble can collapse on the heating resistor, potentially causing cavitation damage and other types of mechanical damage to the resistor, and thus shortening the operational life of the thermal fluid-ejection mechanism.

The related patent application entitled "thermal inkjet printhead with heating element in recessed substrate cavity," filed on Oct. 27, 2009, and assigned patent application number PCT/US2009/062195, provides for a configuration of a heating resistor within a thermal fluid-ejection mechanism that overcomes these problems. In particular, this related patent application describes a thermal fluid-ejection mechanism in which the heating resistor is located on the sidewalls of a cavity within the substrate of the mechanism. As such, when the bubble formed as a result of heating of the resistor collapses, the bubble does not collapse on the resistor itself.

Disclosed herein are refinements of this configuration of a heating resistor within a thermal fluid-ejection mechanism, as well as techniques for fabricating such a thermal fluid-ejection mechanism. In general, a cavity is formed within a substrate having a top surface. The cavity has one or more sidewalls and a floor. The sidewalls are at an angle of greater than or equal to nominally ninety degrees. A patterned conductive layer is formed on the top surface of the substrate and/or on the sidewalls of the cavity. A patterned resistive layer is formed on the sidewalls of the cavity, and is located over the patterned conductive layer where the patterned conductive layer is formed on the sidewalls of the cavity. The patterned resistive layer is formed as a heating resistor of the thermal fluid-ejection mechanism. The conductive layer is formed as a conductor of the thermal fluid-ejection mechanism, to permit electrical activation of the heating resistor to cause fluid to be ejected from the mechanism.

Figure 1A:
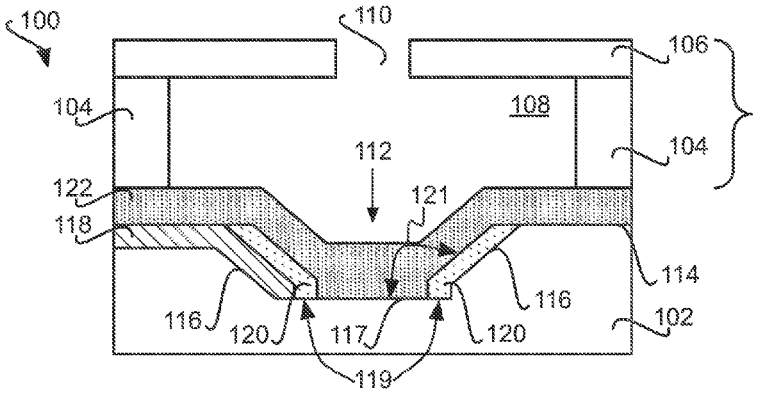
FIGS. 1A and 1B are cross-sectional front view and cross-sectional top view diagrams, respectively, of a first example of a thermal fluid-ejection mechanism having a heating resistor on sidewalls of a cavity.
Figure 1B:
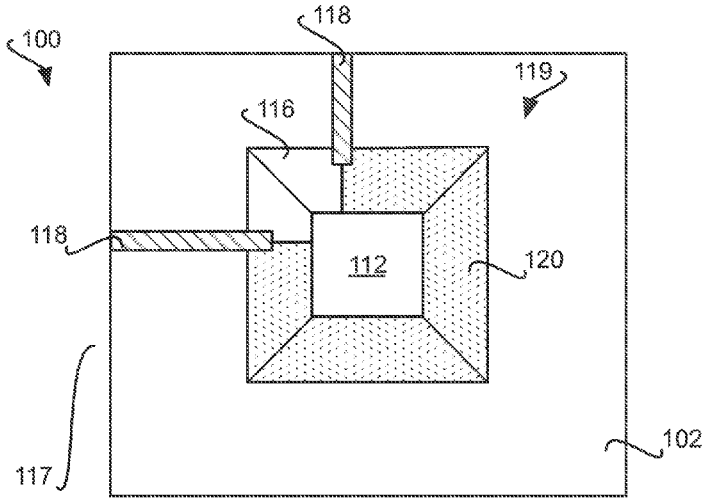

FIGS. 1A and 1B show a cross-sectional front view and a cross-sectional top view, respectively, of a first example of a thermal fluid-ejection mechanism 100 having a heating resistor 119 on sidewalls 116 of a cavity 112 within a substrate 102 of the mechanism 100. The first example may be considered as an example of a first general configurational structure of the thermal fluid-ejection mechanism 100. In FIG. 1A, the thermal fluid-ejection mechanism 100 includes the substrate 102 and a chamber structure 103 having chamber sidewalls 104 and an orifice plate 106. The substrate 102 and the chamber structure 103 define a fluid chamber 108. The orifice plate 106 defines an outlet 110. Fluid is stored in the fluid chamber 108, and is ejected from the fluid-ejection mechanism 100 through the outlet 110. The substrate 102 may be fabricated from silicon, the chamber sidewalls 104 from SU8 photoresist or another type of polymer and/or dielectric, and the orifice plate 106 from electroformed nickel, laser-ablated polyimide, photo-imaged SU8 photoresist, or another type of material.

The cavity 112 is formed in the substrate 102 at a top surface 114 of the substrate 102. The cavity 112 has sidewalls 116 and a floor 117. The sidewalls 116 are at an angle 121 from the floor 117 that is purposefully and meaningfully greater than ninety degrees. That is, this angle 121 is greater than ninety degrees is not a result of manufacturing tolerances and imprecision in the fabrication process of the thermal fluid-ejection mechanism 100 accidentally resulting in the angle 121 being greater than ninety degrees. Rather, the thermal fluid-ejection mechanism 100 in this first example is specifically designed so that the angle 121 is purposefully greater than ninety degrees. For example, the angle 121 may be 144 degrees, which is a wet-etch silicon taper angle.

A conductor of the thermal fluid-ejection mechanism 100 is formed by a patterned conductive layer 118 on a portion of the sidewalls 116 and on a portion of the top surface 114 of the substrate 102. The patterned conductive layer 118 may be fabricated from aluminum. A heating resistor 119 of the thermal fluid-ejection mechanism 100 is formed by a patterned resistive layer 120 on a portion of the sidewalls 116 and on a portion of the patterned conductive layer 118 over the sidewalls 116. The patterned resistive layer may be fabricated from tungsten silicon nitride, tantalum silicon nitride, or tantalum aluminum. A passivation layer 122 can be formed over the substrate 102, the patterned conductive layer 118, and the patterned resistive layer 120, as depicted in FIG. 1A. The passivation layer 122 may be fabricated from tantalum, silicon nitride, or silicon carbide.

The patterned resistive layer 120 is resistive in that it is considered a resistor that has greater resistance than that of the patterned conductive layer 118. Likewise, the patterned conductive layer 118 is conductive in that it is considered a conductor that has greater conductivity than that of the patterned resistive layer 120. The resistance of the patterned resistive layer 120 is many times greater than the resistance of the patterned conductive layer 118; as one example, this resistance ratio may be 500-25,000 or higher. Likewise, the conductance of the patterned conductive layer 118 is many times greater than the conductance of the patterned resistive layer 120; as one example, this conductance ratio may be 500-25,000 or higher.

In FIG. 1B, just the substrate 102, the patterned conductive layer 118, and the patterned resistive layer 120 are depicted for illustrative clarity; the passivation layer 122 and the chamber structure 103 are not depicted in FIG. 1B. The cavity 112, including the sidewalls 116 and the floor 117 thereof, is also called out in FIG. 1B. The pattern of the conductive layer 118 and the pattern of the patterned resistive layer 120 are depicted in FIG. 1B to at least some extent. Applying electrical power between the two conductors formed by the patterned conductive layer 118 causes electrical current to flow through the heating resistor 119 formed by the patterned resistive layer 120. This in turn causes a bubble to form within the fluid of the fluid chamber 108 of FIG. 1A, resulting in a drop of the fluid being ejected from the thermal fluid-ejection mechanism 100 through the outlet 110.

The cavity 112 is polygonal in shape from the top view perspective of FIG. 1B. As such, there are more than two sidewalls 116. In the specific example of FIG. 1B, the cavity 112 is rectangular in shape, such that there are four sidewalls 116, corresponding to the four sides of a rectangle.

Figure 2:
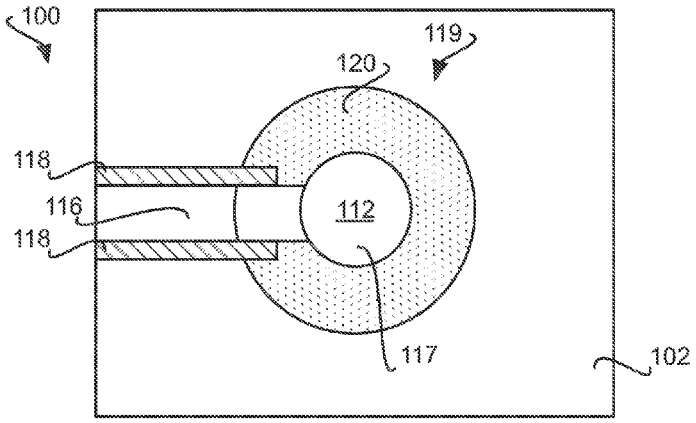
FIG. 2 is a cross-sectional top view diagram of a second example of a thermal fluid-ejection mechanism having a heating resistor on sidewalls of a cavity.

FIG. 2 shows a cross-sectional top view of a second example of the thermal fluid-ejection mechanism 100 having a heating resistor 119 on the sidewalls 116 of the cavity 112 within the substrate 102 of the mechanism 100. The second example may be considered as another example of the first general configurational structure of the thermal fluid-ejection mechanism 100. The cross-sectional front view of this second example of the thermal fluid-ejection mechanism 100 is identical to that depicted in FIG. 1A of the first example of the mechanism 100. The difference between the first and second examples of the thermal fluid-ejection mechanism 100 is primarily that the cavity 112 in the second example of FIG. 2 is curved in shape, whereas the cavity in the first example is polygonal in shape, as depicted in FIG. 1B.

In FIG. 2, just the substrate 102, the patterned conductive layer 118, and the patterned resistive layer 120 are depicted for illustrative clarity; the passivation layer 122 and the chamber structure 103 are not depicted in FIG. 2. The cavity 112, including the sidewalls 116 and the floor 117 thereof, is also called out in FIG. 2. The pattern of the conductive layer 118 and the pattern of the patterned resistive layer 120 are depicted in FIG. 2 to at least some extent. As before, applying electrical power between the two conductors formed by the patterned conductive layer 118 causes electrical current to flow through the heating resistor 119 formed by the patterned resistive layer 120. This in turn causes a bubble to form within the fluid of the fluid chamber 108 of FIG. 1A, resulting in a drop of the fluid being ejected from the thermal fluid-ejection mechanism 100 through the outlet 110.

The cavity 112 is curved in shape from the top view perspective of FIG. 2, as noted above. As such, there is just one sidewall 116. In the specific example of FIG. 2, the cavity 112 is circular in shape. The cavity 112 may further be elliptical in shape, oval in shape, or have a round shape in a different manner.

It is noted that the sidewalls 116 being at an angle 121 greater than nominally ninety degrees in FIGS. 1A, 1B, and 2, as opposed to being equal to nominally ninety degrees, aids fabrication of the thermal fluid-ejection mechanism 100, particularly the heating resistor 119. This is because it is more difficult to deposit the patterned resistive layer 120 on sidewalls 116 that are at an angle 121 equal to nominally ninety degrees, as opposed to being at an angle 121 that is greater than nominally ninety degrees. As such, the thermal fluid-ejection mechanism 100 may be able to be manufactured in a more cost-effective manner.

Figure 3A:
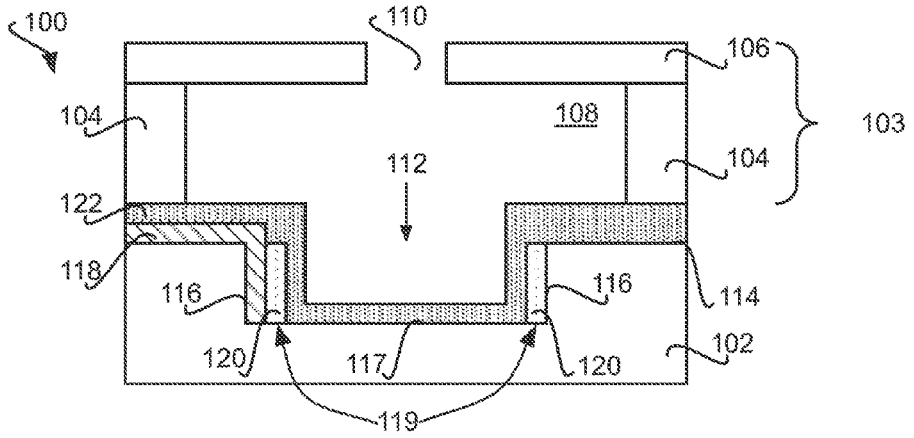
FIGS. 3A and 3B are cross-sectional front view and cross-sectional top view diagrams, respectively, of a third example of a thermal fluid-ejection mechanism having a heating resistor on sidewalls of a cavity.
Figure 3B:
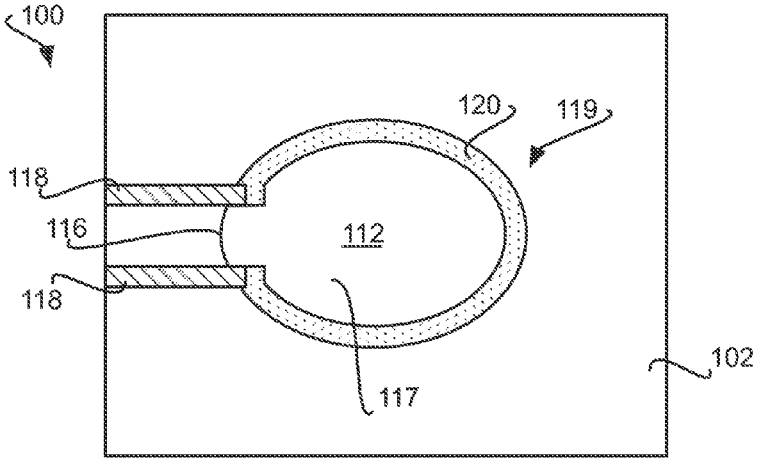

FIGS. 3A and 3B show a cross-sectional front view and a cross-sectional top view, respectively, of a third example of the thermal fluid-ejection mechanism 100 having a heating resistor 119 on the sidewall 116 of the cavity 112 within the substrate 102 of the mechanism 100. The third example may be considered as an example of a second general configurational structure of the thermal fluid-ejection mechanism 100. As in FIG. 1A, in FIG. 3A the thermal fluid-ejection mechanism 100 includes the substrate 102 and the chamber structure 103 having the chamber sidewalls 104 and the orifice plate 106. The substrate 102 and the chamber structure 103 define the fluid chamber 108, and the orifice plate 106 defines the outlet 110, also as in FIG. 1A.

The cavity 112 is again formed in the substrate 102 at the top surface 114 of the substrate 102. The cavity 112 has one sidewall 116 and the floor 117. In the third example of the third thermal fluid-ejection mechanism 100, the sidewall 116 is at an angle 121 from the floor 117 that is nominally ninety degrees. For instance, the thermal fluid-ejection mechanism 100 may be fabricated so that this angle 121 is supposed to be ninety degrees, but manufacturing tolerances and imprecision in the fabrication process may result in the angle 121 being slightly greater than or slightly less than ninety degrees.

A conductor of the thermal fluid-ejection mechanism 100 is formed by the patterned conductive layer 118 on a portion of the sidewall 116 and on a portion of the top surface 114 of the substrate 102, similar to as in FIG. 1A. A heating resistor 119 of the thermal fluid-ejection mechanism 100 is formed by a patterned resistive layer 120 on a portion of the sidewall 116 and on a portion of the patterned conductive layer 118 over the sidewall 116, also similar to as in FIG. 1A. The passivation layer 122 can again be formed over the substrate 102, the patterned conductive layer 118, and the patterned resistive layer 120, as depicted in FIG. 3A.

In FIG. 3B, just the substrate 102, the patterned conductive layer 118, and the patterned resistive layer 120 are depicted for illustrative clarity; the passivation layer 122 and the chamber structure 103 are not depicted in FIG. 3B. The cavity 112, including the sidewall 116 and the floor 117 thereof, is also called out in FIG. 3B. The pattern of the conductive layer 118 and the pattern of the patterned resistive layer 120 are depicted in FIG. 3B. Applying electrical power between the two conductors formed by the patterned conductive layer 118 causes electrical current to flow through the heating resistor 119 formed by the patterned resistive layer 120. This in turn causes a bubble to form within the fluid of the fluid chamber 108 of FIG. 3A, resulting in a drop of fluid being ejected from the thermal fluid-ejection mechanism 100 through the outlet 110.

The cavity 112 is curved in shape from the top view perspective of FIG. 3B. As such, there is just one sidewall 116. In the specific example of FIG. 3B, the cavity 112 is oval in shape. The cavity 112 may further be elliptical in shape, circular in shape, or have a curved shape in a different manner.

Figure 4A:
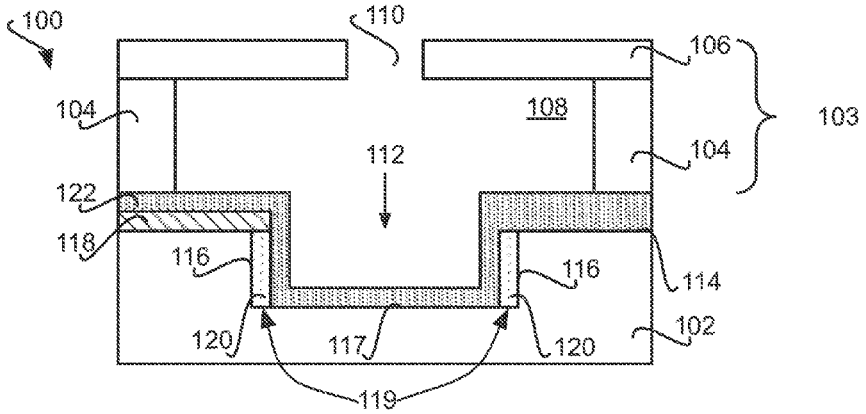
FIGS. 4A and 4B are diagrams of a fourth example of a thermal fluid-ejection mechanism having a heating resistor on sidewalls of a cavity.
Figure 4B:
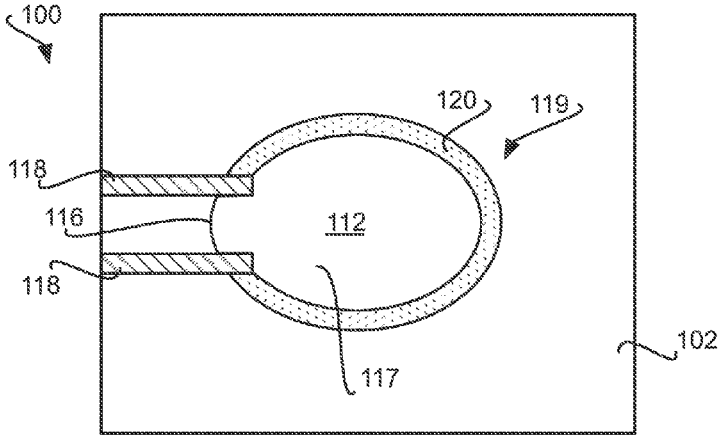

FIGS. 4A and 4B show a cross-sectional front view and a cross-sectional top view, respectively, of a fourth example of the thermal fluid-ejection mechanism 100 having a heating resistor 119 on the sidewall 116 of the cavity 112 within the substrate 102 of the mechanism 100. The first example may be considered as another example of the second general configurational structure of the thermal fluid-ejection mechanism 100. The difference between the third example of the thermal fluid-ejection mechanism 100 in FIGS. 3A and 3B and the fourth example of the mechanism 100 in FIGS. 4A and 4B is primarily the order in which the patterned conductive layer 118 and the patterned resistive layer 120 are formed. In the third example of FIGS. 3A and 3B, the patterned conductive layer 118 is formed before the patterned resistive layer 120 is formed. By comparison, in the fourth example of FIGS. 4A and 4B, the patterned conductive layer 118 can be formed after the patterned resistive layer 120 is formed.

As in FIG. 3A, in FIG. 4A the thermal fluid-ejection mechanism 100 includes the substrate 102 and the chamber structure 103 having the chamber sidewalls 104 and the orifice plate 106. The substrate 102 and the chamber structure 103 define the fluid chamber 108, and the orifice plate 106 defines the outlet 110, also as in FIG. 3A. The cavity 112 is again formed in the substrate 102 at the top surface 114 of the substrate 102. As in FIG. 3A, the cavity 112 has one sidewall 116 and the floor 117, and the sidewall 116 is at an angle 121 from the floor 117 that is nominally ninety degrees.

A heating resistor 119 of the thermal fluid-ejection mechanism 100 is formed by a patterned resistive layer 120 on a portion of the sidewall 116. A conductor of the thermal fluid-ejection mechanism 100 is formed by the patterned conductive layer 118 on a portion of the patterned resistive layer 120 and on a portion of the top surface 114 of the substrate 102. The passivation layer 122 can again be formed over the substrate 102, the patterned conductive layer 118, and the patterned resistive layer 120, as depicted in FIG. 4A.

In FIG. 4B, just the substrate 102, the patterned conductive layer 118, and the patterned resistive layer 120 are depicted for illustrative clarity; the passivation layer 122 and the chamber structure 103 are not depicted in FIG. 4B. The cavity 112, including the sidewall 116 and the floor 117 thereof, is also called out in FIG. 4B. The pattern of the conductive layer 118 and the pattern of the patterned resistive layer 120 are depicted in FIG. 4B to at least some extent. Applying electrical power between the two conductors formed by the patterned conductive layer 118 causes electrical current to flow through the heating resistor 119 formed by the patterned resistive layer 120. This in turn causes a bubble to form within the fluid of the fluid chamber 108 of FIG. 4A, resulting in a drop of fluid being ejected from the thermal fluid-ejection mechanism 100 through the outlet 110.

The cavity 112 is curved in shape from the top view perspective of FIG. 4B, as in FIG. 4A. As such, there is just one sidewall 116. In the specific example of FIG. 4B, the cavity 112 is oval in shape. The cavity 112 may further be elliptical in shape, circular in shape, or have a curved shape in a different manner.

Figure 5:
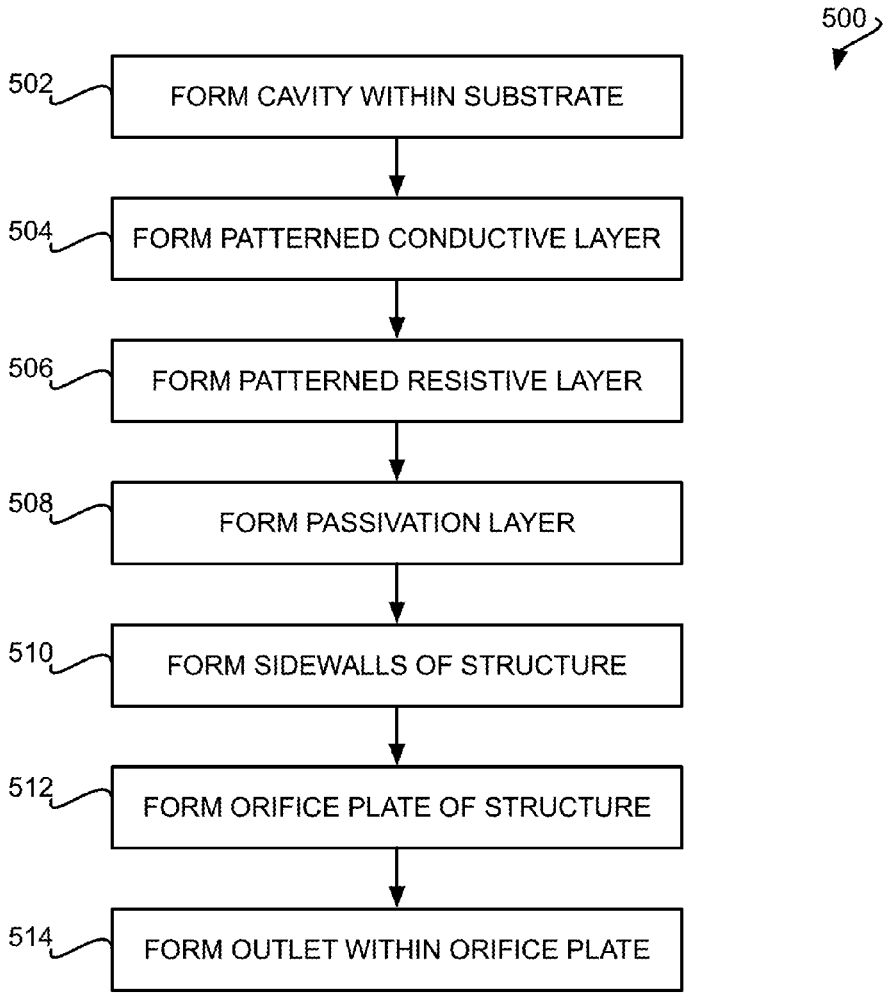
FIG. 5 is a flowchart of an example method for fabricating a thermal fluid-ejection mechanism having a heating resistor on sidewalls of a cavity.

FIG. 5 shows an example method 500 for fabricating the examples of the thermal fluid-ejection mechanism 100 that have been described. There are seven parts 502, 504, 506, 508, 510, 512, and 514 in the example method 500 of FIG. 5. However, not all the parts 502, 504, 506, 508, 510, 512, and 514 have to be performed. Furthermore, the order in which the parts 502, 504, 506, 508, 510, 512, and 514 are performed can vary from the order depicted in FIG. 5. Each of the parts 502, 504, 506, 508, 510, 512, and 514 can be formed using suitable semiconductor-oriented techniques, such as suitable photolithography, deposition, masking, and/or etching techniques, among other types of semiconductor-oriented techniques.

The example method 500 is first described in general relation to the thermal fluid-ejection mechanism 100 of the examples of FIGS. 1A and 1B, of FIG. 2, of FIGS. 3A and 3B, and of FIGS. 4A and 4B. Some portions of the method 500 are then described in specific relation to each example of the thermal fluid-ejection mechanism 100 that has already been described. The cavity 112 is formed within the substrate 102 at the top surface 114 thereof (502). Formation of the cavity 112 results in the cavity 112 having the sidewalls 116 and the floor 117, where the sidewalls 116 are at an angle 121 of greater than or equal to ninety degrees from the floor 117, depending on which example of the thermal fluid-ejection mechanism 100 is being fabricated. Formation of the cavity 112 further results in the cavity 112 having a polygonal shape or a curved shape, depending on which example of the thermal fluid-ejection mechanism 100 is being fabricated.

The patterned conductive layer 118 is formed on one or more of the top surface 114 of the substrate 102 and the sidewalls 116 of the cavity 112 (504). The patterned resistive layer 120 is formed on the sidewalls 116 of the cavity 112, in operative contact with the patterned conductive layer 118 (506). For instance, the patterned resistive layer 120 is formed over the patterned conductive layer 118 where the conductive layer 118 has already been formed on the sidewalls 116. A passivation layer may be formed on the top surface 114 of the substrate 102, the floor 117 of the cavity 112, the patterned conductive layer 118, and/or the patterned resistive layer 120 (508). The chamber sidewalls 104 of the chamber structure 103 are formed (510), as is the orifice plate 106 of the chamber structure 103 (512), thus defining the fluid chamber 108. The outlet 110 is formed in the orifice plate 106 of the chamber structure 103.

Figure 6A:
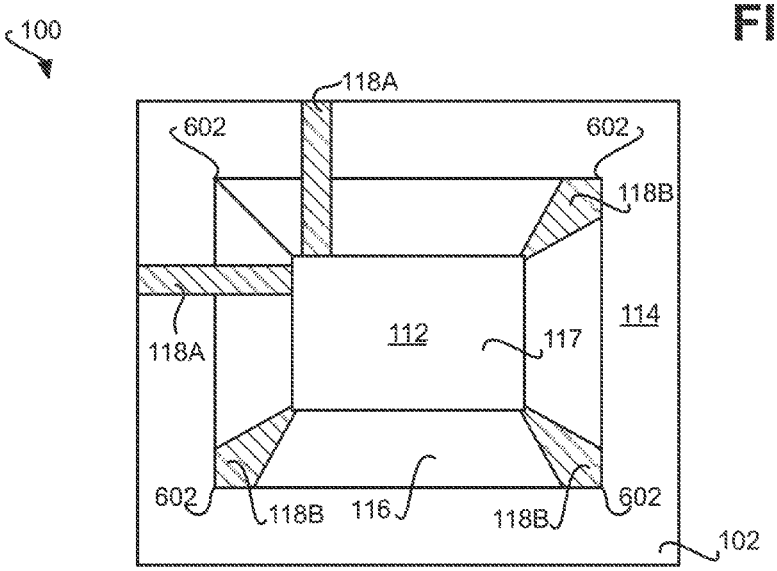
FIGS. 6A, 6B, and 6C are diagrams depicting example illustrative performance of a part of the method of FIG. 5 to fabricate versions of the first example thermal fluid-ejection mechanism of FIGS. 1A and 1B.
Figure 6B:
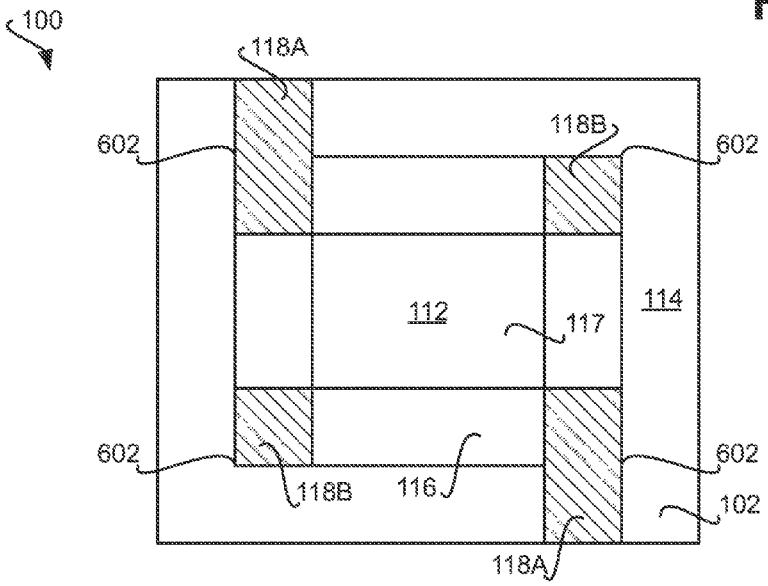
Figure 6C:
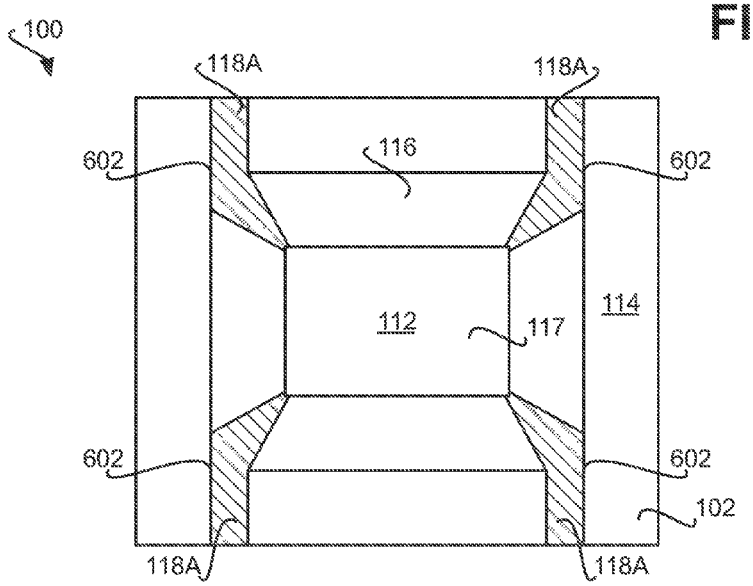

To form the thermal fluid-ejection mechanism 100 of the first example that has been described in relation to FIGS. 1A and 1B, the patterned conductive layer 118 is formed prior to the patterned resistive layer 120 being formed. FIG. 6A shows the thermal fluid-ejection mechanism 100 of the first example specifically shown in FIGS. 1A and 1B. FIGS. 6B and 6C show other versions of the thermal fluid-ejection mechanism 100 of the first example, after the patterned conductive layer 118 is formed in part 504, but before the patterned resistive layer 120 has been formed in part 506. FIGS. 6A, 6B, and 6C thus show the substrate 102, and the cavity 112, including the floor 117 and the sidewalls 116 thereof, in addition to the patterned conductive layer 118, which is made up of the conductive traces 118A and 118B in FIGS. 6A and 6B, and of just the conductive trace 118A in FIG. 6C. As such, the patterned resistive layer 120, and the heating resistor 119, are not depicted in FIGS. 6A, 6B, and 6C.

Because the cavity 112 is in the shape of a polygon in the first example of the thermal fluid-ejection mechanism 100, the cavity 112 has corners 602 where the sidewalls 116 meet. In the example of FIGS. 6A, 6B, and 6C, the polygon in question is a rectangle, such that there are four corners 602. So that the heating resistor 119 that will be subsequently formed (via the patterned resistive layer 120) does not heat unevenly, the corners 602 over which the patterned resistive layer 120 will be formed are first covered by the patterned conductive layer 118. This ensures that electrical current will flow through these corners within the lower-resistance conductive layer 118, instead of within the higher-resistance resistive layer 120. That is, wherever the electrical current flows through the patterned resistive layer 120, the resistive layer 120 is substantially uniform in length from the floor 117 of the cavity 112 to the top surface 114 of the substrate 102.

Therefore, in FIG. 6A, the patterned conductive layer 118 is formed to include conductive traces 118A and conductive segments 118B. During operation of the ultimately formed thermal fluid-ejection mechanism 100, electrical power is applied between the conductive traces 118A to electrically activate the heating resistor 119 to heat this resistor 119. The conductive segments 118B ensure that the electrical current at least substantially bypasses the patterned resistive layer 120 at the corners 602. The upper-left corner 602 does not have a conductive segment 118B thereon, because the patterned resistive layer 120 is not formed at the upper-left corner, as is depicted in FIG. 1B.

In FIG. 6B, the patterned conductive layer 118 is also formed to include the conductive traces 118A and the conductive segments 118B. As such, during operation of the ultimately formed thermal fluid-ejection mechanism 100, electrical power is applied between the conductive traces 118A to electrically activate the heating resistor 119 to heat this resistor 119. The conductive segments 118B in FIG. 6B also ensure that the electrical current at least substantially bypasses the patterned resistive layer 120 at the lower-left and upper-right corners 602.

In FIG. 6C, the patterned conductive layer 118 is formed to include just the conductive traces 118A, and no conductive segments 118B. As in FIGS. 6A and 6B, during operation of the ultimately formed thermal fluid-ejection mechanism 100, electrical power is applied between the conductive traces 118A to electrically activate the heating resistor 119 to heat this resistor 119. If the patterned resistive layer 120 is formed on the left and right sidewalls 116 but not on the top and bottom sidewalls 116, then electrical power is applied between the upper conductive traces and the lower conductive traces. By comparison, if the resistive layer 120 is formed on the upper and lower sidewalls 116 but not on the left and right sidewalls 116, then electrical power is applied between the left conductive traces and the right conductive traces.

To fabricate the thermal fluid-ejection mechanism 100 of the second example that has been described in relation to FIG. 2, the patterned conductive layer 118 may again be formed prior to the patterned resistive layer 120 being formed. The patterned conductive layer 118 may be formed to include just two conductive traces in the specific version of the second example depicted in FIG. 2—which are called out as the patterned conductive layer 118 in FIG. 2—and no conductive segments, which are not needed due to the shape of the cavity 112 being curved. In both the first and second examples of the thermal fluid-ejection mechanism 100, the cavity 112 may be formed by horizontal anisotropic etching in addition to vertical anisotropic etching in part 502, so that the sidewalls 116 form an angle 121 with the floor 117 of the cavity 112 that is purposefully greater than ninety degrees.

As has been described, in some examples disclosed herein, the angle 121 that the sidewalls form with the floor 117 of the cavity 112 is purposefully greater than ninety degrees, whereas in other examples, the angle 121 is nominally ninety degrees. The former case confers certain advantages. In particular, fabrication of such a thermal fluid-ejection mechanism 100 is easier, as compared to fabrication of a thermal fluid-ejection mechanism 100 in which the angle 121 is ninety degrees. This is because most etching techniques etch both horizontally and vertically, as opposed to just vertically. As such, it is difficult to control etching so that primarily just vertical etching occurs, as setting the angle 121 at nominally ninety degrees entails.

To fabricate the thermal fluid-ejection mechanism 100 of the third and fourth examples that have been described in relation to FIGS. 3A and 3B and in relation to FIGS. 4A and 4B, respectively, the patterned conductive layer 118 is also formed to include just two conductive traces in the specific versions of the second and third examples depicted in FIGS. 3A and 3B and in FIGS. 4A and 4B, and no conductive segments. The conductive traces are called out as the patterned conductive layer 118 in FIG. 2. In both the third and the fourth examples of the thermal fluid-ejection mechanism 100, the cavity 112 may be formed just by vertical anisotropic etching without any horizontal anisotropic etching in part 502, so that the sidewalls 116 form an angle 121 with the floor 117 of the cavity 112 that is nominally ninety degrees. In the third example of the thermal fluid-ejection mechanism 100, the patterned conductive layer 118 is formed in part 504 prior to the patterned resistive layer 120 being formed in part 506. By comparison, in the fourth example of the fluid-ejection mechanism 100, the patterned conductive layer 118 is formed in part 504 after the patterned resistive layer 120 has been formed in part 506.

It is noted that having the heating resistor 119 formed on the sidewalls 116 of the cavity 112 and not on the floor 117 confers certain advantages. First, when ejecting a droplet of fluid through the outlet 110, the tail of such a fluid droplet is more likely to be parallel to the chamber sidewalls 104, and thus directly behind the main portion of the droplet. When the fluid droplet contacts the media onto which it is being ejected, the resulting mark on the media caused by the droplet is more likely to be circular or otherwise round in shape. As such, image quality is improved. By comparison, if the tail of the fluid droplet were instead not parallel to the chamber sidewalls 104, then the tail would not be directly behind the main portion of the droplet. The resulting mark of the media caused by the droplet would less likely be circular or otherwise round in shape, because an artifact resulting from the tail would extend from the mark. As such, image quality is lessened.

Second, the process of thermal fluid ejection occurs by the heating resistor 119 heating the fluid contained within the chamber 108, which causes a bubble to form within the fluid. Formation of this bubble results in the ejection of a fluid droplet through the outlet 110. Thereafter, the bubble collapses. It has been found that the forces resulting from collapse of the bubble are primarily directed towards and onto the floor 117. The resulting stress can affect the long-term reliability of the heating resistor 119, if the heating resistor 119 is located on the floor 117. As such, by locating the heating resistor 119 on the sidewalls 116, the resistor 119 is less affected by collapse of the bubble, and thus is more likely to have better long-term reliability than a heating resistor 119 located on the floor 117.

Figure 7:
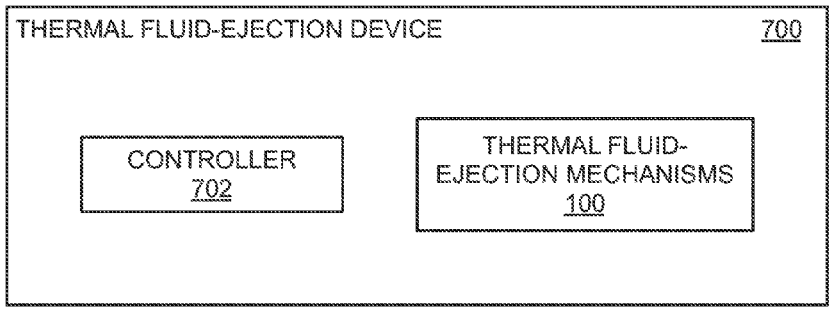
FIG. 7 is a block diagram of an example of a rudimentary thermal fluid-ejection device.

In conclusion, FIG. 7 shows a block diagram of an example thermal fluid-ejection device 700. The thermal fluid-ejection device 700 includes a controller 702 and a number of the thermal fluid-ejection mechanisms 100. The controller 702 may be implemented in hardware, or a combination of machine-readable instructions and hardware, and controls ejection of drops of fluid from the fluid-ejection device 700 in a desired manner by the fluid-ejection mechanisms 100. The fluid-ejection mechanisms 100 themselves may be disposed with one or more fluid-ejection printheads. The fluid-ejection mechanisms 100 include heating resistors 119 formed on the sidewalls of cavities within substrates, as has been described.

It is noted that the fluid-ejection device 700 may be an inkjet-printing device, which is a device, such as a printer, that ejects ink onto media, such as paper, to form images, which can include text, on the media. The fluid-ejection device 700 is more generally a fluid-ejection, precision-dispensing device that precisely dispenses fluid, such as ink, melted wax, or polymers. The fluid-ejection device 700 may eject pigment-based ink, dye-based ink, another type of ink, or another type of fluid. Examples of other types of fluid include those having water-based or aqueous solvents, as well as those having non-water-based or non-aqueous solvents. However, any type of fluid-ejection, precision-dispensing device that dispenses a substantially liquid fluid may be used.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

We claim:

1. A method for fabricating a thermal fluid-ejection mechanism, comprising:

forming a cavity within a substrate having a top surface, the cavity having one or more sidewalls and a floor, the sidewalls at an angle of greater than or equal to nominally ninety degrees from the floor;

forming a patterned conductive layer on one or more of the top surface of the substrate and the sidewalls of the cavity; and, forming a patterned resistive layer on just the sidewalls and not on the floor of the cavity, the patterned resistive layer located over the patterned conductive layer where the patterned conductive layer is formed on the sidewalls of the cavity, wherein the patterned resistive layer is formed as a heating resistor of the thermal-fluid ejection mechanism, and the conductive layer is formed as a conductor of the thermal-fluid ejection mechanism to permit electrical activation of the heating resistor to cause fluid to be ejected from the thermal fluid-ejection mechanism.

2. The method of claim 1, further comprising forming a structure on the substrate, the structure defining a fluid chamber in which the fluid is stored prior to ejection from the thermal-ejection mechanism, wherein forming the structure comprises:

forming one or more sidewalls of the structure;

forming an orifice plate of the structure on the sidewalls of the structure; and, forming an outlet within the orifice plate.

3. The method of claim 1, wherein the cavity is formed such that the angle at which the sidewalls are from the floor is greater than nominally ninety degrees, wherein forming the patterned conductive layer comprises forming a plurality of conductive traces extending from the top surface of the cavity to the sidewalls of the cavity, and wherein the patterned resistive layer is formed after the patterned conductive layer is formed.

4. The method of claim 3, wherein the cavity is formed such that the cavity is polygonal in shape from a top view perspective of the thermal fluid-ejection mechanism, such that the sidewalls of the cavity are more than two in number, and such that the cavity has a plurality of corners, wherein forming the patterned conductive layer further comprises forming a conductive segment on the sidewalls of the cavity at each of one or more selected corners of the corners of the cavity.

5. The method of claim 3, wherein the cavity is formed such that the cavity is curved in shape from a top view perspective of the thermal fluid-ejection mechanism, and such that the sidewalls of the cavity are one in number.

6. The method of claim 1, wherein the cavity is formed such that the angle at which the sidewalls are from the floor is nominally ninety degrees, such that the cavity is curved in shape from a top view perspective of the thermal fluid-ejection mechanism, and such that the sidewalls of the cavity are one in number.

7. The method of claim 6, wherein the patterned resistive layer is formed after the patterned conductive layer is formed, wherein forming the patterned conductive layer comprises forming a plurality of conductive traces extending from the top surface of the cavity to the sidewalls of the cavity, and wherein forming the patterned resistive layer comprises forming the patterned resistive layer on the sidewalls of the cavity and over the conductive traces on the sidewalls of the cavity.

8. The method of claim 6, wherein the patterned conductive layer is formed after the patterned resistive layer is formed, wherein forming the patterned conductive layer comprises forming a plurality of conductive traces extending from the top surface of the cavity to the patterned resistive layer on the sidewalls of the cavity.

9. A thermal fluid-ejection mechanism comprising:

a substrate having a top surface and defining a cavity having one or more sidewalls and a floor, the sidewalls at an angle of greater than or equal to nominally ninety degrees from the floor;

a conductor comprising a patterned conductive layer on one or more of the top surface of the substrate and the sidewalls of the cavity; and, a heating resistor comprising a patterned resistive layer on just the sidewalls and not on the floor of the cavity, the patterned resistive layer located over the patterned conductive layer where the patterned conductive layer is on the sidewalls of the cavity, wherein electrical activation of the heating resistor via the conductor causes fluid to be ejected from the thermal fluid-ejection mechanism.

10. The thermal fluid-ejection mechanism of claim 9, further comprising a structure on the substrate and defining a fluid chamber in which the fluid is stored prior to ejection from the thermal fluid-ejection mechanism, the structure comprising one or more sidewalls and an orifice plate on the sidewalls of the structure and defining an outlet.

11. The thermal fluid-ejection mechanism of claim 9, wherein the cavity is polygonal in shape from a top view perspective of the thermal fluid-ejection mechanism, the sidewalls of the cavity are more than two in number, the cavity has a plurality of corners, and the angle at which the sidewalls are from the floor is greater than nominally ninety degrees, wherein the patterned conductive layer comprises a plurality of conductive traces extending from the top surface of the cavity to the sidewalls of the cavity, and a conductive segment on the sidewalls of the cavity at each of one or more selected corners of the corners of the cavity, and wherein the patterned resistive layer is located over the patterned conductive layer.

12. The thermal fluid-ejection mechanism of claim 9, wherein the cavity is curved in shape from a top view perspective of the thermal fluid-ejection mechanism, the sidewalls of the cavity are one in number, and the angle at which the sidewalls are from the floor is greater than nominally ninety degrees, wherein the patterned conductive layer comprises a plurality of conductive traces extending from the top surface of the cavity to the sidewalls of the cavity, and wherein the patterned resistive layer is located over the patterned conductive layer.

13. The thermal fluid-ejection mechanism of claim 9, wherein the cavity is curved in shape from a top view perspective of the thermal fluid-ejection mechanism, the sidewalls of the cavity are one in number, and the angle at which the sidewalls are from the floor is nominally ninety degrees, wherein the patterned conductive layer comprises a plurality of conductive traces extending from the top surface of the cavity to the sidewalls of the cavity, and wherein the patterned resistive layer is located on the sidewalls of the cavity and over the conductive traces on the sidewalls of the cavity.

14. The thermal fluid-ejection mechanism of claim 9, wherein the cavity is curved in shape from a top view perspective of the thermal fluid-ejection mechanism, the sidewalls of the cavity are one in number, and the angle at which the sidewalls are from the floor is nominally ninety degrees, wherein the patterned resistive layer is located on the sidewalls of the cavity, and wherein the patterned conductive layer comprises a plurality of conductive traces extending from the top surface of the cavity to the patterned resistive layer on the sidewalls of the cavity.

15. A thermal fluid-ejection device comprising:

a plurality of thermal fluid-ejection mechanisms to thermally eject fluid in drops, each thermal fluid-ejection mechanism comprising a ring-type heating resistor; and, a controller to control thermal ejection of the fluid by the thermal fluid-ejection mechanisms, wherein each thermal fluid-ejection mechanism comprises:

a substrate having a top surface and defining a cavity having one or more sidewalls and a floor, the sidewalls at an angle of greater than nominally ninety degrees from the floor;

a conductor comprising a patterned conductive layer on one or more of the top surface of the substrate and the sidewalls of the cavity; and, a heating resistor comprising a patterned resistive layer on just the sidewalls and not on the floor of the cavity, the patterned resistive layer located over the patterned conductive layer where the patterned conductive layer is on the sidewalls of the cavity.

* * * * *

UNITED STATES PATENT AND TRADEMARK OFFICE

CERTIFICATE OF CORRECTION

PATENT NO. : 8,939,552 B2
APPLICATION NO. : 13/978571
DATED : January 27, 2015
INVENTOR(S) : Peter Mardilovich et al.

It is certified that error appears in the above-identified patent and that said Letters Patent is hereby corrected as shown below:

On the title page, item (54) and in the specification, in column 1, line 1, Title, delete "ECHANISM" and insert -- MECHANISM --, therefor.

Signed and Sealed this
Twenty-sixth Day of May, 2015

Michelle K. Lee

Michelle K. Lee
*Director of the United States Patent and Trademark Office*